US009568291B2

(12) United States Patent
Simon et al.

(10) Patent No.: US 9,568,291 B2
(45) Date of Patent: Feb. 14, 2017

(54) PROJECTILE CASING FOR AN EXPLOSIVE PROJECTILE AND METHOD FOR HANDLING A PROJECTILE CASING

(75) Inventors: Alexander Simon, München (DE); Ernst Tripp, München (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 827 days.

(21) Appl. No.: 13/994,093

(22) PCT Filed: Dec. 2, 2011

(86) PCT No.: PCT/DE2011/075296
§ 371 (c)(1),
(2), (4) Date: Jun. 13, 2013

(87) PCT Pub. No.: WO2012/097790
PCT Pub. Date: Jul. 26, 2012

(65) Prior Publication Data

US 2013/0255524 A1 Oct. 3, 2013

(30) Foreign Application Priority Data

Dec. 15, 2010 (DE) ..... 10 2010 061 272

(51) Int. Cl.
*F42B 12/24* (2006.01)
*F42B 33/00* (2006.01)

(52) U.S. Cl.
CPC ..... *F42B 12/24* (2013.01); *F42B 33/00* (2013.01)

(58) Field of Classification Search
CPC ..... F42B 12/24; F42B 33/00
See application file for complete search history.

(56) References Cited

U.S. PATENT DOCUMENTS 4,068,590 A * 1/1978 Pearson ..... F42B 12/24 102/493
4,592,283 A 6/1986 Hellner et al.
(Continued)

FOREIGN PATENT DOCUMENTS

DE 2126351 4/1978
DE 2837638 3/1979
(Continued)

OTHER PUBLICATIONS

PCT, International Search Report; Patent Application No. PCT/DE2011/075296 (May 29, 2012).
(Continued)

*Primary Examiner* — Troy Chambers
*Assistant Examiner* — Joshua Semick
(74) *Attorney, Agent, or Firm* — Thompson Hine LLP

(57) ABSTRACT

A fragmentable projectile casing for an explosive projectile (7) has an irregular wall thickness (W) and predetermined breaking points (2) distributed over the projectile casing (1) for formation of fragments. The predetermined breaking points (2) for obtaining uniform fragments are spaced irregularly from one another. The predetermined breaking points (2) can have a smaller distance from one another in a region of greater wall thickness (W) and can be arranged in the manner of a grid and/or are formed as lines. Further, the predetermined breaking points (2) can run parallel to a longitudinal axis (L) of the projectile casing (1) and/or along a circumference (U) of the projectile casing (1).

18 Claims, 2 Drawing Sheets

(56) References Cited

U.S. PATENT DOCUMENTS

| | | | | | |
|---|---|---|---|---|---|
| 4,745,864 | A | 5/1988 | Craddock | | |
| 4,774,745 | A | 10/1988 | Carter | | |
| 5,040,464 | A * | 8/1991 | Pearson | F42B 12/24 | 102/493 |
| 5,157,225 | A * | 10/1992 | Adams | F42B 12/24 | 102/493 |
| 6,484,642 | B1 * | 11/2002 | Kuhns | F42B 12/24 | 102/493 |
| 7,093,542 | B2 * | 8/2006 | Gousman | F42B 12/22 | 102/493 |
| 7,451,704 | B1 * | 11/2008 | Gold | F42B 12/205 | 102/494 |
| 7,667,158 | B2 * | 2/2010 | Dance | B23K 15/08 | 219/121.66 |
| 7,743,707 | B1 * | 6/2010 | Melin | F42C 19/0842 | 102/493 |
| 8,161,884 | B1 * | 4/2012 | Kokodis | F42B 12/24 | 102/476 |
| 8,973,503 | B2 * | 3/2015 | Dunaway | F42B 12/24 | 102/374 |
| 2010/0018427 | A1 * | 1/2010 | Roland | F41H 11/11 | 102/305 |
| 2010/0117888 | A1 | 5/2010 | Simon | | |
| 2010/0199875 | A1 * | 8/2010 | Weihrauch | F42B 12/208 | 102/492 |
| 2011/0262277 | A1 * | 10/2011 | Sjoqvist | F01D 9/041 | 416/213 R |
| 2012/0192754 | A1 * | 8/2012 | Scheid | F42B 12/24 | 102/495 |

FOREIGN PATENT DOCUMENTS

| | | | | |
|---|---|---|---|---|
| DE | 2941480 | | 4/1980 | |
| DE | 10025105 | | 11/2001 | |
| DE | 10151897 | | 5/2003 | |
| DE | 102007007403 | | 8/2008 | |
| EP | 0163029 | | 12/1985 | |
| EP | 1582837 | | 10/2005 | |
| FR | 2961590 | A1 * | 12/2011 | F24B 12/24 |
| GB | 2013842 | | 8/1979 | |

OTHER PUBLICATIONS

PCT, Written Opinion; Patent Application No. PCT/DE2011/075296 (Jun. 15, 2013).

* cited by examiner

PROJECTILE CASING FOR AN EXPLOSIVE PROJECTILE AND METHOD FOR HANDLING A PROJECTILE CASING

BACKGROUND OF THE INVENTION

The instant application should be granted the priority dates of Dec. 15, 2010, the filing date of the corresponding German patent application 10 2010 061 272.3, as well as Dec. 2, 2011, the filing date of the International patent application PCT/DE2011/075296.

The invention relates to a fragmentable projectile casing for an explosive projectile, with predetermined breaking points distributed over the projectile casing for the shaping of fragments. The invention further relates to a method for handling a fragmentable projectile casing for an explosive projectile, with predetermined breaking points distributed over the projectile casing for the shaping of fragments.

Explosive projectiles are used, for example, as artillery ammunition. DE 10 2007 007 403 A1 describes an explosive projectile for assault ammunition bodies, for example mortar grenades or rockets.

In addition to a projectile casing, explosive projectiles typically have an explosive charge disposed within the projectile casing. As a result of firing the explosive charge into the target or in the area of the target, the projectile casing splinters into a plurality of fragments. The fragments are accelerated by the pressure of the detonation of the explosive charge and act on the target with a corresponding kinetic energy. Thus, an explosive projectile primarily acts by the fragmentation of its projectile casing.

The effect of the explosive projectile depends in a large degree on the formation of fragments. For example, upon detonation of the explosive charge, in addition to those fragments which can receive sufficient kinetic energy based on their masses to act on the target, also fragments are formed which based on having a mass that is too small or too great do not act on the target or act only in a limited peripheral manner on the target. In this manner, the shape or surface of the fragments affects their effectiveness. For example, fragments, which have an unfavorable shape, are slowed down based on their air resistance.

In order to achieve predominantly fragments with the desired shape upon detonation of the explosive charge, the projectile casing can be provided with predetermined breaking points. For example, DE 21 26 351 C1 describes a projectile casing, which has predetermined breaking points distributed uniformly over the projectile casing. By means of these predetermined breaking points, the formation of the fragments can be effected, such that more fragments with the desired shape are created.

When shooting an explosive projectile from a barrel of a weapon, in particular with spin-stabilized explosive projectiles, large forces are transferred onto the projectile casing. In order to ensure the strength of the projectile casing also during these increased demands, the projectile casings often have an irregular wall thickness. For example, regions of the projectile casing that are heavily stressed can be formed to be correspondingly thicker.

With such projectile casings with irregular wall thicknesses, it has been considered to be a disadvantage to provide uniformly distributed predetermined breaking points, since with detonation of the explosive charge, also an irregular fragment formation is provided from the irregular wall thickness. In addition, if the shape of the fragments is similar by uniformly distributed predetermined breaking points, the masses of the fragments, however, would differ greatly from one another. In the areas of smaller and larger wall thickness, fragments form with masses that are too small or too large, which are not effective or only marginally effective, whereby the effect of such explosive projectiles on the target is impaired.

A further disadvantage of the projectile casing known from DE 21 26 241 C1 is that the predetermined breaking points are formed as lines running along the circumference of the projectile casing as well as along a direction parallel to the longitudinal axis of the projectile casing, whereby only the predetermined breaking points running in the circumferential direction extend over the entire wall thickness. Thus, the projectile casing slants, such that upon detonation, the explosive charge breaks in the circumferential direction rather than in the longitudinal direction. It is possible that the predetermined breaking points do not break in the longitudinal direction. The result is an irregular formation of fragments and a reduced effect of the explosive projectile upon fragmentation of the projectile casing.

SUMMARY OF THE INVENTION

The object of the invention is to provide a fragmentable projectile casing and a method for treatment of a fragmentable projectile casing, which have an improved effect on the target.

This object is solved by a fragmentable projectile casing for an explosive projectile with an irregular wall thickness and with predetermined breaking points distributed over the projectile casing for formation of fragments, in that the predetermined breaking points are spaced irregularly from one another for achieving uniform fragments.

The predetermined breaking points can be arranged in with non-uniform spacing between from one another. In this manner, the number of fragments, whose masses lie in a desired range, can be increased. At the same time, the number of fragments that are too heavy and/or too light can be reduced. Thus, an improved fragment formation with an increased number of effective fragments can be made possible. The effect of the explosive projectile caused by fragmentation of the projectile casing can be improved.

Next, further embodiments of a projectile casing will be explained, whereby first, the arrangement of the predetermined breaking points will be described in greater detail.

According to an advantageous embodiment, it is first proposed that the predetermined breaking points have a smaller distance from one another in a region of greater wall thickness. In this manner, the effect is that the regions of greater wall thickness break into fragments of the desired mass upon detonation of the explosive charge. In a comparable manner, the predetermined breaking points can have a greater distance from one another in a region having a smaller wall thickness. As a result, the projectile casing likewise breaks into fragments of the desired mass in a region of smaller wall thickness. Thus, the predetermined breaking points can be arranged depending on the wall thickness, such that they have similar shapes and masses also with irregular wall thickness. It is possible that the predetermined breaking points respectively have a distance from one another that is adapted to the wall thickness.

In a further embodiment, it is provided that the predetermined breaking points are formed as lines. The lines can run straight or curved. The predetermined breaking points can be arranged in the manner of aligned points which form predetermined breaking lines. In addition, the predetermined breaking points can be formed as continuous lines.

Further advantageous is an embodiment in which the predetermined breaking points are arranged in the manner of a grid. The individual predetermined breaking points can be part of a predetermined breaking grid, which extends over the entire projectile casing. Based on the grating of the projectile casing by the predetermined breaking points, a uniform formation of fragments can be achieved. The grid can be formed in the manner of a dot matrix or a linear grid. It is possible that the grid is formed as predetermined breaking lines. In addition, the grid extends in the direction of the surface of the projectile casing and/or in the direction of the wall thickness of the projectile casing. The grid can have meshes of irregular size. In particular, the sizes of the meshes of the grid can be adapted to the wall thickness of the projectile casing.

In addition, in a constructive embodiment it is proposed that the predetermined breaking points run parallel to a longitudinal axis of the projectile casing and/or along the circumference of the projectile casing. The predetermined breaking points can be made in an advantageous manner by automated methods in the projectile casing. In particular, with rotationally symmetrical projectile casings, predetermined breaking points can be produced, which run along the circumference, during rotation of the projectile casing about its longitudinal axis in a simple manner by means of a fixed processing device.

According to a further embodiment, it is proposed that the predetermined breaking points, which run parallel to a longitudinal axis of the projectile casing, are spaced irregularly from one another and that the predetermined breaking points, which run along the circumference of the projectile casing, are spaced uniformly from one another. In particular, with projectile casings, whose wall thickness is irregular in the longitudinal direction, predetermined breaking points that are irregularly spaced from one another in the longitudinal direction can affect a uniform fragment formation. This type of predetermined breaking grid, in which the predetermined breaking points are spaced irregularly from one another in the longitudinal direction, can compensate irregularities in the fragment formation. In this manner, also with a projectile casing with wall thicknesses that are irregular in the longitudinal direction, a uniform formation of fragments can be effected.

In a preferred embodiment, the fragments have a mass in the range of 5 g to 9 g. Fragments in this weight range are particularly advantageous for defense of offensive bodies in the air, for example mortar grenade or rockets. Based on their mass, they have a kinetic energy with the explosion of the explosive projectile, which is suited for disarming flying missiles. These types of fragments can penetrate the casings of offensive bodies and prevent or cause a premature detonation of an explosive charge of the offensive body.

Next, further embodiments of a projectile casing according to the present invention will be explained, whereby the configuration of the predetermined breaking points will be described in greater detail.

In a further embodiment, the predetermined breaking points are formed as points with reduced hardness. By means of the reduced hardness of the material in the area of the predetermined breaking points, the projectile casing can break upon detonation of the explosive charge with greater probability in the area of the predetermined breaking points. The predetermined breaking points can be formed as changes in material structure. By means of the predetermined breaking points, hard projections can be produced in the material of the projectile casing. In particular, with predetermined breaking points arranged in a grid, a solid grid can be formed in the projectile casing. Alternatively, the predetermined breaking points can be formed as mechanical predetermined breaking points, in particular as indentations or notches.

Particularly advantageous is an embodiment, in which the predetermined breaking points are produced by heat treatment, in particular by electron beam welding and/or laser welding. The material of the projectile casing can be melted momentarily in a limited region by heat treatment. In the regions treated by heat, changes in material structure in the projectile casing can be formed. The material structural changes can be inhomogenities in the material of the projectile casing, which affect the predetermined breaking points. In particular, the changes in material structure can have increased brittleness relative to the rest of the material of the projectile casing.

A projectile casing according to the present invention was described above, as well as advantageous embodiments of this projectile casing, which despite an irregular wall thickness, enables a uniform formation of fragments. Next, a projectile casing according to the present invention and its advantageous embodiments will be described, in which the predetermined breaking points break with an increase probability and therewith, ensures a uniform fragmentation.

With a fragmentable projectile casing for an explosive projectile, with predetermined breaking points for formation of fragments distributed over the projectile casing, the above described object is solved, in that the predetermined breaking points are formed as changes in material structure running in the direction of the longitudinal axis, which extend over the entire wall thickness.

By means of the changes in material structure, predetermined breaking points are formed in the longitudinal direction of the projectile casing. The predetermined breaking points can extend over the entire wall thickness, whereby the predetermined breaking points break upon detonation of the explosive charge with increased probability. The effect of the explosive projectile caused by fragmentation of the projectile casing can be improved in this manner.

In a further embodiment, it is proposed that the predetermined breaking points are formed as changes in material structure running along the circumference of the projectile casing, which extend over the entire wall thickness. Thus, the projectile casing can have a predetermined breaking grid, which is formed by continuous changes in material structure.

In addition, the advantageous embodiment described in connection with the previously described, fragmentable projectile casing with an irregular wall can be used with the previously described projectile casing.

With a method according to the present invention for treatment of a fragmentable projectile casing for an explosive projectile, with an irregular wall thickness and with predetermined breaking points distributed over the projectile casing for formation of fragments, the object described initially is solved, in that the predetermined breaking points are spaced irregularly from one another in order to achieve uniform fragments.

The predetermined breaking points can be arranged in nonuniform distance from one another. In this manner, the number of fragments, whose mass lies in a desired range, can be increased. At the same time, the number of fragments that are too heavy and/or too light can be reduced. Thus, an improved formation of fragments with an increased number of effective fragments is made possible. The affect created by fragmentation of the projectile casing can be improved.

With the previously described method, the advantageous embodiments noted in connection with the projectile casing of the present invention can be used in an analogous manner.

With a method for treatment of a fragmentable projectile casing for an explosive projectile, with predetermined breaking points distributed over the projectile casing for formation of fragments, the initially described object is solved, in that the predetermined breaking points are formed as changes in material structure running in the direction of the longitudinal axis, which extend over the entire wall thickness.

By applying the continuous changes in material structure, predetermined breaking points can be formed in the longitudinal direction of the projectile casing. The predetermined breaking points can extend over the entire wall thickness, whereby the predetermined breaking points break upon detonation of the explosive charge with increased probability. The effect of the explosive charge caused by fragmentation of the projectile casing can thereby be improved.

In an advantageous embodiment of the method, the predetermined breaking points are formed by heat treatment, in particular by electron beam welding and/or laser welding. By means of heat treatment, the material of the projectile casing can be momentarily melted in a defined area. In the regions that are heat treated, changes in the material structure can be formed in the projectile casing. The changes in material structure can be softer than the remaining material of the projectile casing, whereby they act as predetermined breaking points. In addition, the predetermined breaking points can be made by heat treatment in a contactless manner in the projectile casing. It is possible to produce predetermined breaking points in the projectile casing without removing material from the projectile casing.

In a further embodiment of the method, it is proposed that the projectile casing is moved relative to a fixed heat source. The heat source can be arranged during process of the projectile casing immovable at a fixed position. In addition, the projectile casing can be moved by means of a receiving device, under, over, or laterally to the heat source. By movement of the projectile casing, the arrangement of the predetermined breaking points on the projectile casing can be predetermined.

In addition, a method is proposed in which the surface of the projectile casing is smoothed after application of the predetermined breaking points. By means of the heat treatment, heightening of the material on the surface of the projectile casing can be produced, which negatively affect flight characteristics of the explosive projection. The material heightenings can be removed by mechanical methods, such as, for example, turning, milling, planning, filing, grinding, lapping or slide grinding.

The previously described methods can be used on the one hand in connection with the method first described above and on the other hand, in connection with the projectile casing according to the present invention described above.

BRIEF DESCRIPTION OF THE DRAWINGS

Further details and advantages of a projectile casing according to the present invention as well as a corresponding method for treatment of a projectile casing will be explained next with reference to an exemplary embodiment shown in the figures. In the figures.

DETAILED DESCRIPTION OF THE PREFERRED EMBODIMENTS

Figure 1:
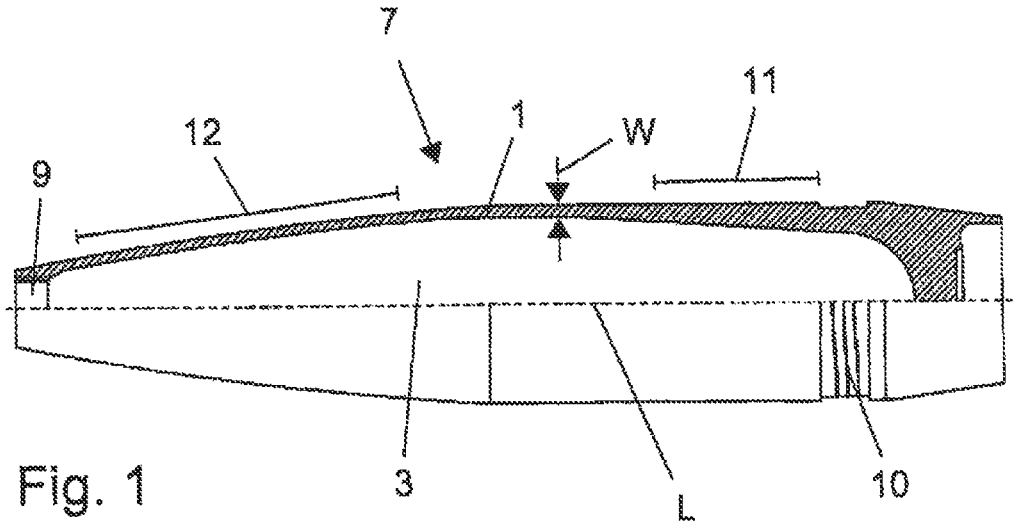
FIG. 1 shows a partially cut lateral view of an explosive projectile.

FIG. 1 shows an explosive projectile 7, which is suitable for shooting with a large caliber (for example 155 mm) artillery gun. The explosive projectile 7 has a fragmentable projectile casing 1 as well as an explosive charge 3 arranged within the projectile casing 1. Further, in the front region of the explosive projectile 7, an igniter 9 for igniting the explosive charge 3 is provided.

A groove 10 is arranged on the surface 8 of the projectile casing 1, in which a guide belt can be accommodated. By means of the guide belt, a rotary motion can be transferred to the explosive projectile 7 upon shooting of the explosive projectile 7 from a pulled-out barrel of the gun. Further, a propellant charge is inserted in the barrel of the gun typically behind the region of the groove 10, which is ignited for shooting the explosive projectile 7. In this manner, large forces are transferred to the region behind the groove 10. In order to enable stability of the projectile casing 1 in the region of the groove 10 upon shooting the explosive projectile 7, the wall thickness W of the projectile casing 1 increases in the region of the groove 10. Thus, the wall thickness W runs unevenly in the direction of the longitudinal axis L of the projectile casing 1.

The effect of the explosive projectile 7 depends on the fragmentation of the projectile casing 1. The explosive projectile 7 is shot from the barrel of the gun in the direction of a target. As soon as the explosive projectile 7 is located in the area of the target, the detonation of the explosive charge 3 takes place by means of the igniter 9. As a result of the pressure in the projectile casing 1 produced by the detonation, the projectile casing 1 shatters into a plurality of fragments, which are accelerated by the detonation and impact the target. Based on the essentially cone-shaped dispersion of the fragments after detonation, the explosive projectile is suitable in particular for defense of offensive missiles, such as mortar grenades or rockets for example.

With explosive projectiles commonly known in the state of the art, with fragmentation of the projectile casing 1, in addition to effective fragments which can receive sufficient kinetic energy based on their base in order to reach the target, also fragments are formed that have too small or too large of a mass, and therefore do not impact the target or only impact the target in a limited manner. In order to achieve a fragment formation with a high number of effective fragments, with the projectile casing 1 according to the present invention, predetermined breaking points 2 for formation of fragments are distributed over the projectile casing 1, as will be described below. In this manner, a uniform formation of fragments is achieved.

For defense of missiles, the fragments have a mass in the range of 5 g to 9 g, which is particularly effective. With other targets, however, effective fragments can have a mass that deviates from the above range.

Figure 3:
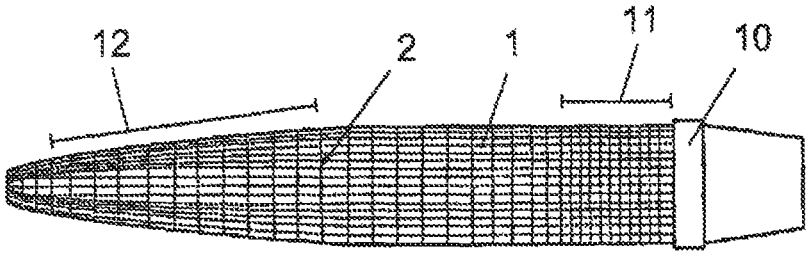
FIG. 3 shows in lateral view a schematic representation of a projectile casing for illustrating the arrangement of the predetermined breaking points.

As shown in FIG. 3, the predetermined breaking points 2 are formed as lines in the projectile casing 1, which are distributed in the manner of a grid over the projectile casing 1. The grid is formed from predetermined breaking points 2, which run along the circumference U of the projectile casing 1 and are spaced uniformly from one another, as well as predetermined breaking points 2, which run parallel to the longitudinal axis L of the projectile casing 1, and have irregular distances from one another.

In areas of the projectile casing 1, which have a greater wall thickness W, such as in the region 11 of the groove 10, for example, the predetermined breaking points 2 are spaced more closely from one another as in region which have a smaller wall thickness W. A region 12 with smaller wall thickness W is located in the front, conical part of the projectile casing 1. In this region 12, the predetermined breaking points 2 are spaced correspondingly wide from one another.

By the irregular arrangement of the predetermined breaking points 2, a uniform fragment formation with detonation of the explosive charge 3 is effected. The projectile casing 1 shatters into fragments with similar masses. The plurality of fragments that are too heavy or too light is therefore reduced and the greatest number of effective fragments is produced.

In addition, the predetermined breaking points 2 are formed as points with reduced hardness, so that the projectile casing 1 has a rigid grid. These types of predetermined breaking points 2 can be formed by changes in material structure, which are produced by heat treatment of the projectile casing 1, for example by electron beam welding or by laser welding. With this type of heat treatment, the material structure of the projectile casing 1 can be changed in a range of a few millimeters. The material is locally melted at the selected points. With the subsequent cooling, the material then hardens into a structure, which has a reduced strength compared to that of the original material structure. The changes in material structure can be formed as martensite and/or bainite, so-called intermediate stage structure. A removal of material does not occur with the heat treatment.

The predetermined breaking points 2, which run in the direction of the longitudinal axis L, as well as the predetermined breaking points 2, which run along the circumference U, further are applied in the projectile casing 1 such that they extend over the entire wall thickness W. The predetermined breaking points 2, therefore, are not limited to the surface 8 of the projectile casing 1, but completely permeate the projectile casing 1. Based on these continuously formed changes of the material structure, the probability of breaking with fragmentation of the projectile casing 1 in the direction of the longitudinal axis L as well as along the circumference U at the predetermined breaking points 2 is increased.

Next, a method for treatment of a fragmentable projectile casing 1 will be described with reference to the illustration in FIG. 2.

Figure 2:
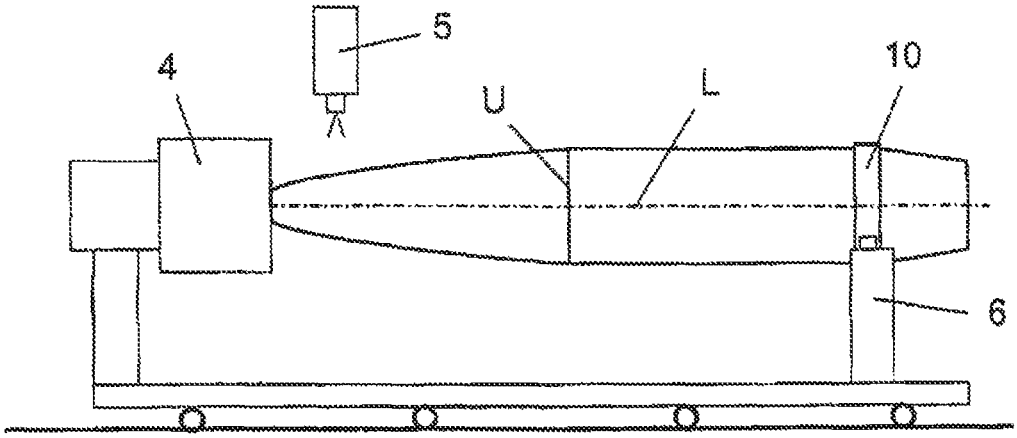
FIG. 2 shows in a lateral view a schematic representation of a receiving device for a projectile casing for illustrating the treatment method.

FIG. 2 shows a projectile casing, which is held by means of a receiving device 6 and a turning device 4 in an essentially horizontal position. In the region above the projectile casing 1, a heat source 5 is fixedly arranged. With the heat source 5, for example, an electron beam welding device or a laser welding device, the projectile casing 1 can be heated in a contactless manner in a limited region.

By means of the immovable heat source 5, the material of the projectile casing 1 moved beneath the heat source 5 is locally melted. The region of the projectile casing 1, on which the heat source can act, has a width from 1 mm to 3 mm and extends over the entire wall thickness W of the projectile casing 1. In the melted region of the projectile casing 2, as described previously, changes in the material structure are formed, which act as predetermined breaking points 2. By movement of the projectile casing 1, the predetermined breaking points 2 are applied in the material, which form the continuous lines of a grid.

With the processing of the projectile casing 1 with the heat source 5, the projectile casing 1 is moved relative to the fixed heat source 5. For making predetermined breaking points 2, which extend along a direction parallel to the longitudinal axis L of the projectile casing 1, the receiving device 6 can be moved together with the projectile casing 1 in the direction of the longitudinal axis L relative to the heat source 5. The receiving device 6 holds the projectile casing 1 in the region of the groove 10 and guides it in its movement parallel to the longitudinal axis L.

The manufacture of predetermined breaking points 2, which extend along the circumference U of the projectile casing 1, takes place by rotation of the projectile casing 1 relative to the heat source 5. On its front end, the projectile casing 1 is mounted rotatably in a turning device 4, with which the projectile casing 1 can be rotated beneath the heat source 5.

With the method according to the present invention, the predetermined breaking points 2 are irregularly spaced from one another to achieve uniform fragments. A linear predetermined breaking point 2 is produced along the circumference U, by applying the fixed heat source 5 in a punctiform manner on the projectile casing 1, while this is rotated about the longitudinal axis L at 360°. Before production of a further, linear predetermined breaking point 2 along the circumference that is spaced from this predetermined breaking point 2, the receiving device 6 is moved at an amount that corresponds with the spacing of the two predetermined braking points 2. The spacing of the predetermined breaking points, therefore, is adapted to the wall thickness W of the projectile casing 1.

For producing predetermined breaking points 2, which run along a direction parallel to the longitudinal axis, the projectile casing 1 moves along its entire length relative to the heat source 5 through the receiving device 6. A spacing between the predetermined breaking points 2 running parallel to the longitudinal axis L can be achieved, in that the projectile casing 1 is rotated at a predetermined angle after manufacture of a predetermined breaking point 2 running along the longitudinal axis L. In this manner, predetermined breaking points 2 that are uniformly spaced along the circumference U are produced, which run along the longitudinal axis. Since the wall thickness W of the projectile casing 1 is uniform along the circumference, also the spacing of the predetermined breaking points 2 are uniformly formed along the circumference.

In order to increase the probability of breaking of the projectile casing 1 at the predetermined breaking points 2, the predetermined breaking points 2 running in the longitudinal direction L and along the circumference are formed as changes in material structure, which extend over the entire wall thickness W of the projectile casing 1.

Figure 4:
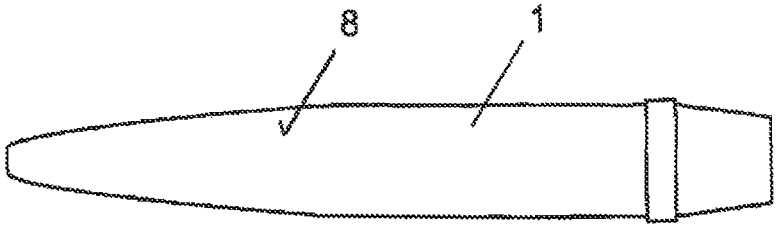
FIG. 4 shows in lateral view a schematic representation of a projectile casing.

As a result of the heat treatment, increases in the height of the material can form on the surface 8 of the projectile casing 1. These increases in height are removed in a further processing step. The surface 8 of the projectile casing 1 is smoothed, so that a flat surface 8 is provided (see FIG. 4). For smoothing of the surface 8, a mechanical method can be used, such as for example turning, milling, planning, filing, grinding, lapping or slide finishing.

With the fragmentable projectile casing 1 for an explosive projectile 7 described above, with an irregular wall thickness W and with predetermined breaking points 2 for formation of fragments distributed over the projectile casing 1, the predetermined breaking points 2 are spaced irregularly from one another in order to achieve uniform fragments. In this manner, the number of fragments whose mass lies in a desired range can be increased. At the same time, the number of fragments that are too heavy and/or too light can be reduced. Thus, an improved fragmenting can be made possible with an increased number of effective fragments.

The specification incorporates by reference the disclosure of DE 10 2010 061 272.3 filed Dec. 15, 2010, as well as International application PCT/DE2011/075296, filed Dec. 2, 2011.

The present invention is, of course, in no way restricted to the specific disclosure of the specification and drawings, but also encompasses any modifications within the scope of the appended claims.

REFERENCE NUMERALS

1 projectile casing
2 predetermined breaking point
3 explosive charge
4 turning device
5 heat source
6 receiving device
7 explosive projectile
8 surface
9 igniter
10 groove
11 region
12 region
L longitudinal axis
U circumference
W wall thickness

The invention claimed is:

1. A fragmentable projectile casing for an explosive projectile (7), the projectile casing comprising:

an irregular wall thickness (W) having a first region having a first wall thickness and a second region having a second wall thickness less than the wall thickness of the first region; and predetermined breaking points (2) distributed over the projectile casing (1) for formation of fragments upon detonation of the explosive projectile, wherein the predetermined breaking points (2) are spaced irregularly from one another such that the fragments have uniform masses within a predetermined range.

2. The projectile casing according to claim 1, wherein the predetermined breaking points (2) have a smaller distance from one another in the first region.

3. The projectile casing according to claim 1, wherein the predetermined breaking points (2) are arranged in the manner of a grid and/or are formed as lines.

4. The projectile casing according to claim 1, wherein the predetermined breaking points (2) run parallel to a longitudinal axis (L) of the projectile casing (1) and along a circumference (U) of the projectile casing (1).

5. The projectile casing according to claim 4, wherein the predetermined breaking points (2) running parallel to a longitudinal axis (L) of the projectile casing (1) are spaced irregularly from one another, and wherein the predetermined breaking points (2) running along the circumference (U) of the projectile casing (1) are spaced uniformly from one another.

6. The projectile casing according to claim 1, wherein the predetermined range of the fragments is 5 g to 9 g.

7. The projectile casing according to claim 1, wherein the predetermined breaking points (2) are formed as points with reduced hardness.

8. The projectile casing according to claim 1, wherein the predetermined breaking points (2) are formed by heat treatment, in particular by electron beam welding.

9. The projectile casing according to claim 1, wherein the predetermined breaking points (2) are formed as material structural changes running in the direction of a longitudinal axis (L) of the projectile casing.

10. The projectile casing according to claim 1, wherein the predetermined breaking points (2) are formed as material structural changes running along a circumference (U) of the projectile casing (1).

11. A method for treatment of a fragmentable projectile casing (1) for an explosive projectile (7), with an irregular wall thickness (W) and with predetermined breaking points (2) for formation of fragments distributed over the projectile casing (1), the method comprising:

spacing the predetermined breaking points (2) for obtaining fragments irregularly from one another such that the fragments have uniform masses that lie in a predetermined range.

12. A method for treatment of a fragmentable projectile casing for an explosive projectile (7), the projectile casing having an irregular wall thickness (W) with a first region of a first wall thickness and a second region of a second wall thickness less than the first wall thickness, and with predetermined breaking points (2) for formation of fragments distributed over the projectile casing (1), the method comprising:

forming the predetermined breaking points (2) as changes in material structure running in the direction of a longitudinal axis (L) of the projectile casing; and distributing the predetermined breaking points (2) over the projectile casing (1), such that the predetermined breaking points (2) are spaced irregularly from one another so that, upon detonation of the explosive projectile, the fragments have uniform masses that lie in a predetermined range.

13. The method according to claim 11, wherein the predetermined breaking points (2) are produced by heat treatment.

14. The method according to claim 13, wherein the heat treatment is electron beam welding and/or laser welding.

15. The method according to claim 12, wherein the projectile casing (1) is moved relative to a fixed heat source (5).

16. The method according to claim 12, wherein a surface (8) of the projectile casing (1) is smoothed after application of the predetermined breaking points (2).

17. The projectile casing according to claim 1, wherein the predetermined breaking points (2) run parallel to a longitudinal axis (L) of the projectile casing (1).

18. The projectile casing according to claim 1, wherein the predetermined breaking points (2) run along a circumference (U) of the projectile casing (1).

* * * * *